US007775295B1

(12) United States Patent
Glaser et al.

(10) Patent No.: US 7,775,295 B1
(45) Date of Patent: Aug. 17, 2010

(54) PROPORTIONAL PILOT-CONTROLLED PNEUMATIC CONTROL SYSTEM FOR PNEUMATICALLY POWERED HAND-HELD TOOLS

(75) Inventors: Donald J. Glaser, Emporia, KS (US); Lon C. Tidwell, Emporia, KS (US); Kevin M. James, Emporia, KS (US)

(73) Assignee: Glendo Corporation, Emporia, KS (US)

( * ) Notice: Subject to any disclaimer, the term of this patent is extended or adjusted under 35 U.S.C. 154(b) by 121 days.

(21) Appl. No.: 12/018,623

(22) Filed: Jan. 23, 2008

(51) Int. Cl.
*B25D 9/14* (2006.01)

(52) U.S. Cl. ..... 173/200; 173/115; 173/128; 137/455

(58) Field of Classification Search ..... 173/115, 173/200, 128, 2; 137/455, 505.12, 505.14
See application file for complete search history.

(56) References Cited

U.S. PATENT DOCUMENTS 2,915,079 A * 12/1959 Harrison ..... 137/86
3,393,755 A * 7/1968 Glaser et al. ..... 173/200
4,185,385 A * 1/1980 Simor ..... 433/28
4,201,051 A * 5/1980 Hall ..... 60/407
4,275,691 A * 6/1981 Wolff et al. ..... 123/352
4,481,768 A * 11/1984 Goshorn et al. ..... 60/327
4,741,365 A * 5/1988 Van Ornum ..... 137/625.65
4,767,327 A * 8/1988 Smithwick et al. ..... 433/98
4,895,184 A * 1/1990 Abbey ..... 137/625.29
4,903,784 A * 2/1990 Glaser ..... 173/200
5,107,899 A * 4/1992 Murphy ..... 137/884
5,203,417 A * 4/1993 Glaser ..... 173/200
5,333,941 A * 8/1994 Hart et al. ..... 303/40
5,394,693 A * 3/1995 Plyter ..... 60/325
5,515,930 A 5/1996 Glaser
5,878,569 A * 3/1999 Satzler ..... 60/418
5,884,894 A * 3/1999 Smith ..... 251/28
6,050,081 A * 4/2000 Jansen et al. ..... 60/39.094
6,076,549 A 6/2000 Bahat et al.
6,095,256 A 8/2000 Lindsay
6,460,629 B2 10/2002 Bookshar et al.
6,508,823 B1 1/2003 Gonon (Continued)

OTHER PUBLICATIONS

Instructions and Parts Manual for Pneumatic Air Scribe, Model No. CP-9361, sold by Chicago Pneumatic Tool Co.; Dated Jul. 1984.

(Continued)

*Primary Examiner*—Rinaldi I. Rada
*Assistant Examiner*—Lindsay Low
(74) *Attorney, Agent, or Firm*—Hovey Williams LLP

(57) ABSTRACT

A control system for use in conjunction with a primary power system and operable to control a pneumatically powered hand-held tool broadly comprises an air delivery assembly operable to communicate with a pressurized air source; a control assembly including an exhaust line from the primary power system and to the control assembly, a spool valve in fluid communication with the supply line and the exhaust line, and a control line in fluid communication with the spool valve and the hand-held tool; a tool assembly comprising the hand-held tool for performing delicate hand working operations; and a housing for at least partial storage of the air delivery assembly and the control assembly. The primary power system and the control system operate in conjunction with each other to both power and precisely control a pneumatically powered hand-held tool.

13 Claims, 13 Drawing Sheets

U.S. PATENT DOCUMENTS

| | | | | |
|---|---|---|---|---|
| 6,691,798 | B1 | 2/2004 | Lindsay | |
| 6,705,199 | B2 * | 3/2004 | Liao et al. | 91/363 R |
| 6,799,501 | B2 * | 10/2004 | Yo et al. | 91/361 |
| 6,966,340 | B2 * | 11/2005 | Lee | 137/625.69 |
| 7,048,073 | B2 * | 5/2006 | Hezeltine | 173/1 |
| 7,076,314 | B2 * | 7/2006 | Saitou | 700/56 |
| 7,210,394 | B2 * | 5/2007 | Yajima et | 91/361 |
| 7,353,743 | B2 * | 4/2008 | Bugel et al. | 91/392 |
| 7,533,664 | B2 * | 5/2009 | Carnall | 124/77 |

OTHER PUBLICATIONS

Declaration of Public Use of Certain Prior Art Devices; U.S. Appl. No. 12/018,623, filed Jan. 23, 2008; Applicant: Glaser, et al.

* cited by examiner

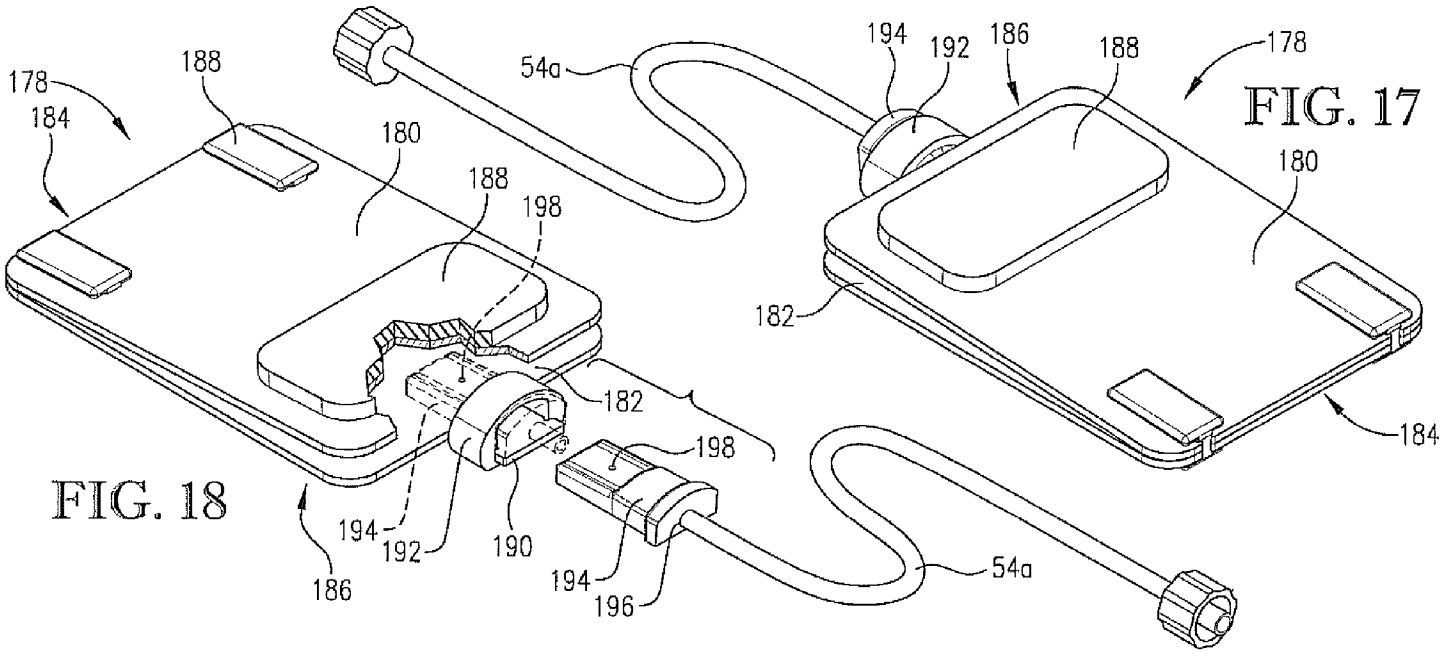
FIG. 17
FIG. 18
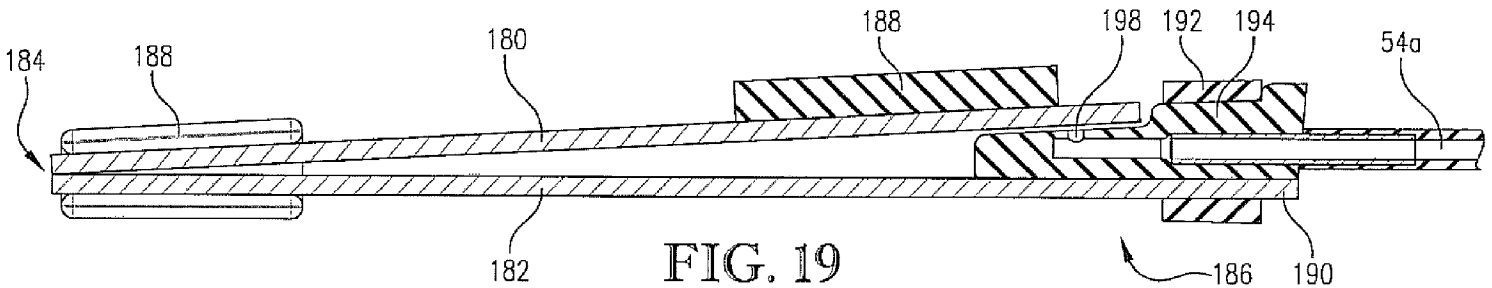
FIG. 19

PROPORTIONAL PILOT-CONTROLLED PNEUMATIC CONTROL SYSTEM FOR PNEUMATICALLY POWERED HAND-HELD TOOLS

BACKGROUND

1. Field

The present invention relates to pneumatic control systems for pneumatically powered hand-held tools. More particularly, the invention relates to proportionally controlled systems that allow for a distinct source of pressurized air to power the tool and to control the tool.

2. Description of the Related Art

Hand-held pneumatic power tools have been used for many years to increase the range of hand work in fields including hand engraving, jewelry stone setting, wood carving, and other similar tasks. Typically, these tools are designed to provide a variable range of power so that a user can produce desired results across a broad range of applications. To provide the user with variable power control, such pneumatic tools often have a control mechanism, such as a mechanical valve, either on the tool itself or within a separate control device, such as a foot control, to vary the air flow and/or pressure to or through the tool. Such valves often include a spring-loaded plunger that variably opens and closes an opening to increase or decrease the flow of pressurized fluid to the tool. Tools having mechanical valves have many disadvantages, however.

First, although mechanical valves are inexpensive, problems reported by users include inconsistent or excessive operating force and lack of repeatability. As can be appreciated, it is desirable that the tool provides the same amount of pressure based on the same actuation of the valve by the user. However, this is often not the case with prior art tools. Moreover, the tools are often not able to be used at low operating forces, which are preferred for delicate engraving, chiseling, or carving.

A second problem of prior art tools that use mechanical valves is that the tools do not provide the necessary control. For the delicate hand-working operations these tools are used for, it is necessary for the user to have complete control over the tool. Many prior art tools, however, exhibit mechanical friction and "stick/slip" within the tool. This prevents consistency during use and results in unexpected consequences when the tool sticks or slips during use. Moreover, the mechanical valves often have only a few levels of power output that can be selected by the user. This does not provide the desired control because it does not allow for the precision that accompanies selective power output over a range of values.

A third problem of prior art tools having mechanical valves is that the valves are not amenable to the high-stress environments that the tools are used in. For example, because the tools are used for engraving, chiseling, or carving, dust and debris is often pervasive, and such dust and debris irritates, wears, and hinders the performance of mechanical valves. Moreover, the mechanical parts of the valves become worn over time and must be replaced. Therefore, there is a need for a mechanism for controlling the tools that does not rely on a mechanical valve with multiple moving parts.

A fourth problem of prior art tools having mechanical valves is that the plunger of the valve exhibits appreciable mechanical travel. This directly affects the response time of the tool and/or the user's ability to precisely control the tool. For delicate operations, it is undesirable to have a slow response time.

A fifth problem of prior art tools is the lack of work flexibility due to the fixed configuration of the valve. Because a valve on a tool cannot be readily moved to another location or have its operating characteristics easily changed, tools having mechanical valves are not conducive to being used or held in a variety of ways. For example, for a hand-held tool, the valve is in one position, and thus, in order for the user to actuate the valve to vary the power, the user has only one option of holding the tool, namely the way in which the valve can be actuated. However, there are a variety of ways to hold and power a hand-held tool, such as with use of various fingers, the thumb, and the palm. Therefore, a hand-held tool that can be powered in a plurality of ways dependent on the user's preference is desirable.

Finally, depending on the physical attributes of the user, the user's preferred work configuration, such as sitting or standing, the specific task being performed, the size and shape of the article being worked on, and other factors, the optimum arrangement for the tool, including the preferred type of tool (e.g., hand-held tool or foot-controlled tool), may differ widely. Therefore, it is desirable to have several types of tools, including hand-held tools and foot-controlled tools, that can all be controlled in the same manner.

Accordingly, there is a need for an improved power tool that overcomes the limitations of the prior art. More particularly, there is a need for a new control system operable to variably control the power tool and to provide a mechanism that allows for more precision control and finesse of the power tool.

SUMMARY

The present invention solves the above-described problems and provides a distinct advance in the art of pneumatic control systems for pneumatically powered hand-held tools. More particularly, embodiments of the present invention provide a control system for use in conjunction with a primary power system. The primary power system is operable to power a hand-held tool, and in particular, to drive a piston housed in the hand-held tool. The control system of embodiments of the present invention is operable to precisely control the amount of power to the tool.

The control system broadly comprises an air delivery assembly having a first pressurized air supply line operable to communicate with a pressurized air source; a control assembly including an exhaust line from the primary power system and to the control assembly, a spool valve in fluid communication with the first pressurized air supply line and the exhaust line, and a control line in fluid communication with the spool valve and the hand-held tool; and a second pressurized air supply line in fluid communication with the primary power system and the hand-held tool. The primary power system and the control system operate in conjunction with each other, such that the primary power system exhausts pressurized air to the spool valve of the control system. The amount of and rate of exhaustion of pressurized air from the control system is dependent upon the amount of pressurized air expelled by the user from a control point comprising an orifice on the hand-held tool in fluid communication with the control line. By controlling the amount of air expelled from the control point, the user is able to control the amount of and rate of air exhausted from the spool valve, which consequently selectively drives the piston of the hand-held tool.

Embodiments of the present invention also provide a power tool system comprising a hand-held power tool that can be precisely controlled without a mechanical valve. In particular, the power tool system comprises the hand-held power tool for powering of a hammer tool, wherein the power tool comprises a first hollowed chamber, a spring housed within the first hollowed chamber, and a piston housed within the first hollowed chamber and operable to drive the hammer tool; a control line in fluid communication with a control system and the power tool system and operable to supply pressurized air to the power tool system; a control point for selective expulsion of the pressurized air supplied to the power tool system; and a pressurized air supply line extending from a pressurized air source and to the first hollowed chamber and operable to drive the piston. The control point of the power tool system can either be formed on or associated with the hand-held power tool, a fingerpiece used with the hand-held power tool, or a footpiece used with the hand-held power tool.

BRIEF DESCRIPTION OF THE DRAWING FIGURES

Embodiments of the present invention are described in detail below with reference to the attached drawing figures, wherein:

FIG. 17 is a perspective view of a footpiece of embodiments of the present invention;

FIG. 18 is a partial fragmentary perspective view of the footpiece of embodiments of the present invention and particularly illustrating a wedge (both in solid line and in phantom) removably held in the footpiece;

FIG. 19 is a vertical cross-sectional view of the footpiece of embodiments of the present invention;

Figure 1:
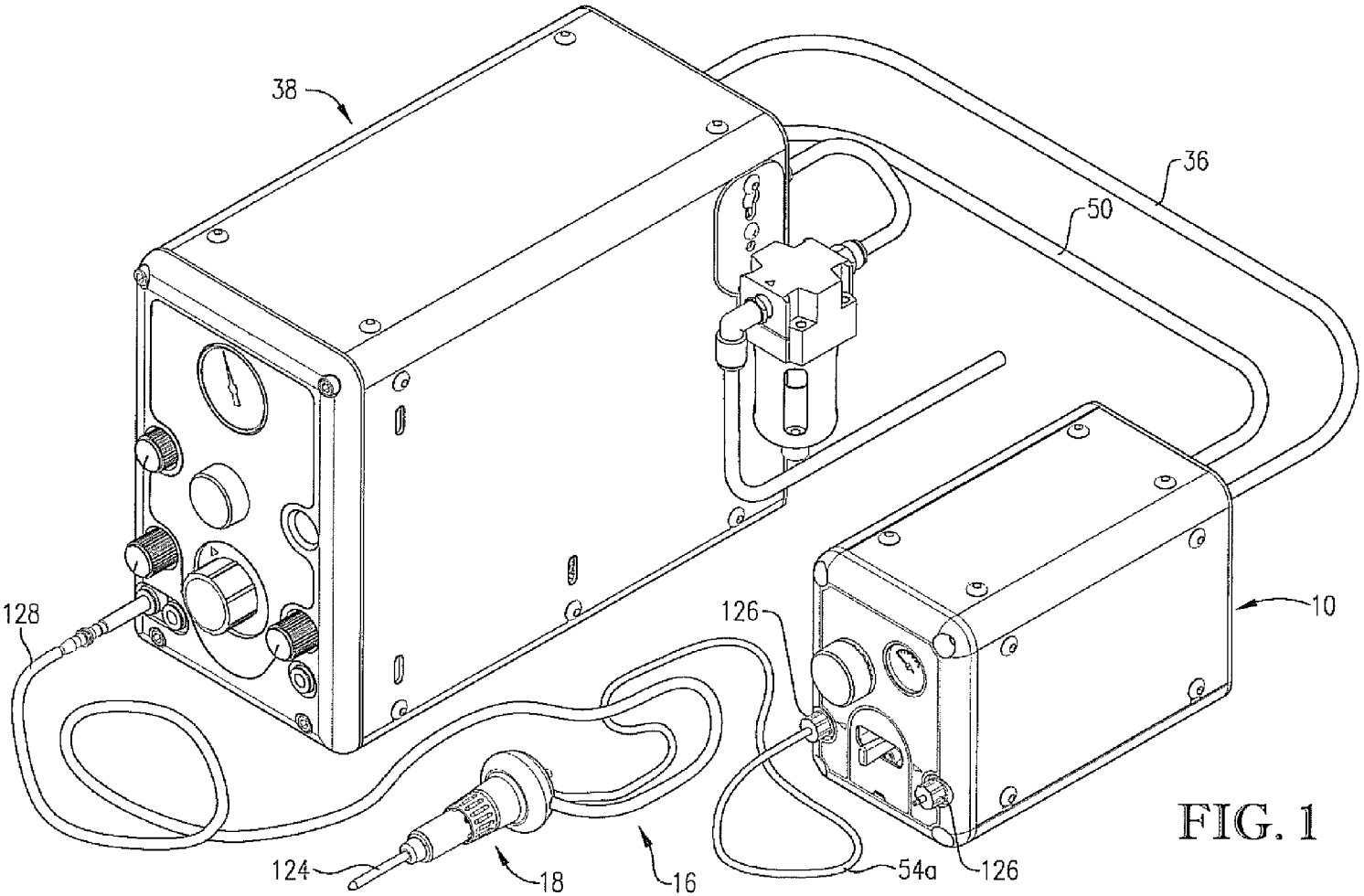
FIG. 1 is a perspective view of a control system of embodiments of the present invention used in conjunction with a primary power system.

The drawing figures do not limit the present invention to the specific embodiments disclosed and described herein. The drawings are not necessarily to scale, emphasis instead being placed upon clearly illustrating the principles of the invention.

DETAILED DESCRIPTION

Figure 2:
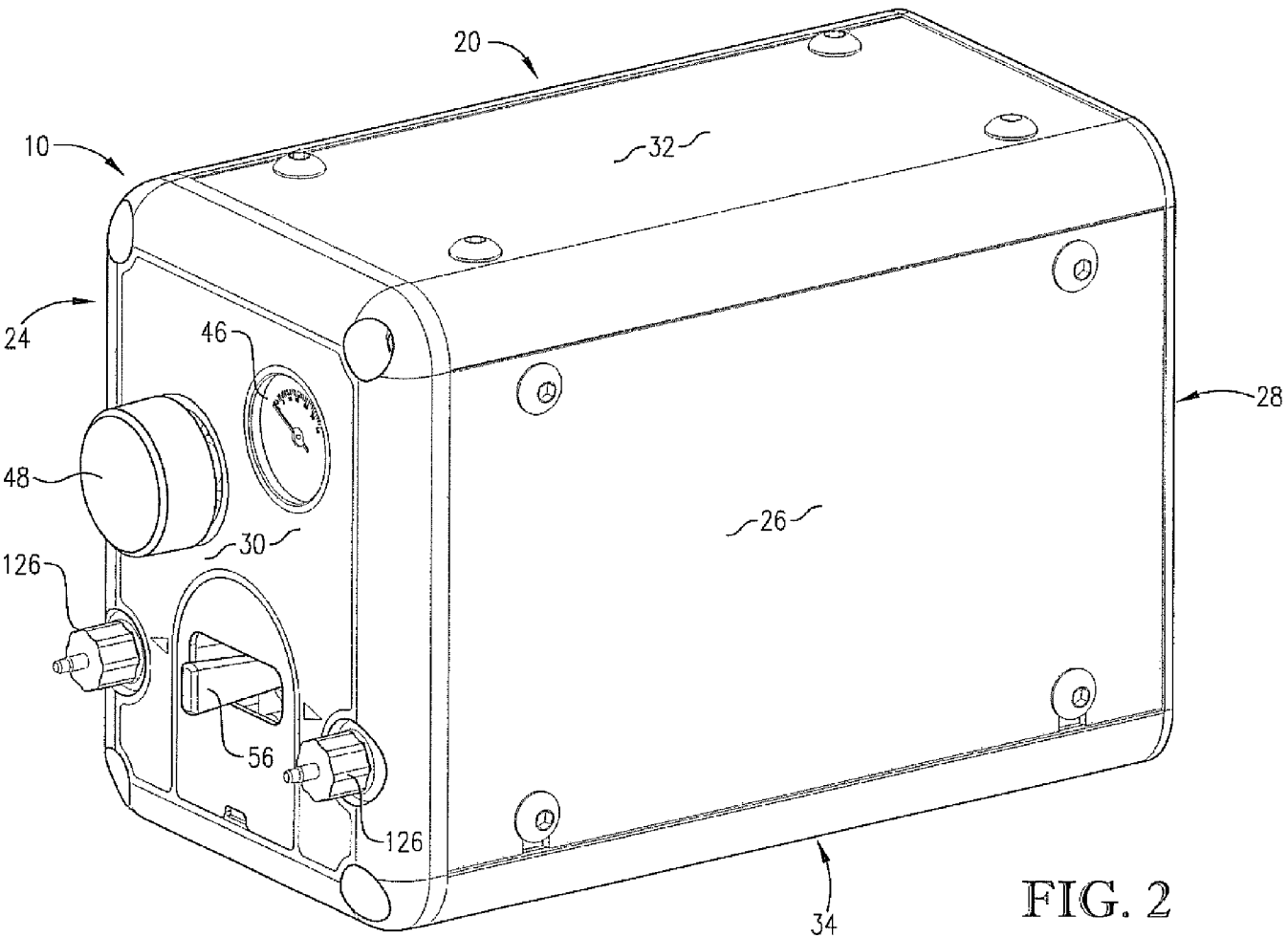
FIG. 2 is a perspective view of the control system of embodiments of the present invention.
Figure 3:
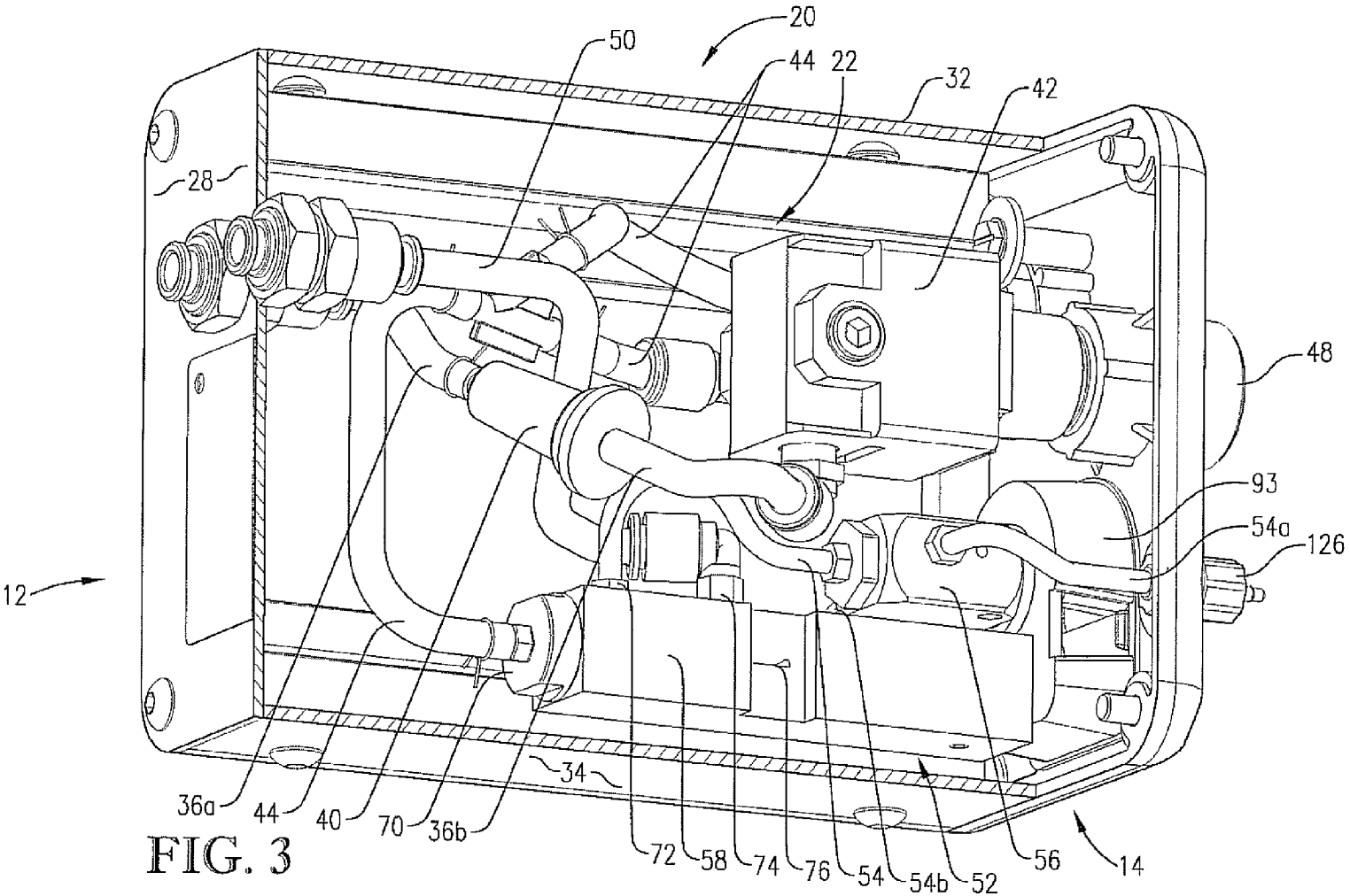
FIG. 3 is side perspective view of the control system and particularly illustrating various internal components within a housing of the system.

Turning now to the drawing figures, and particularly FIGS. 1-3, a proportional pilot-controlled pneumatic control system 10 constructed in accordance with embodiments of the invention is illustrated. The control system 10 provides for precision manual control of pressurized air for use in delicate hand working operations. The control system 10 of embodiments of the present invention broadly comprises an air delivery assembly 12 operable to communicate with a pressurized air source (not shown); a control assembly 14 operable to receive air from the pressurized air source via the air delivery assembly 12; a tool assembly 16 comprising a pneumatically powered hand-held tool for performing delicate hand working operations, hereinafter referred to as a handpiece 18, the handpiece 18 being in driven communication with the pressurized air source and the control assembly 14; and a housing 20 for at least partial storage of the air delivery assembly 12 and the control assembly 14 and defining an interior space 22 and comprising left and right side panels 24,26, back and front panels 28,30, and top and bottom panels 32,34, all of which are discussed in more detail below.

The air delivery assembly 12 comprises a supply line 36 of pressurized air from a primary power system 38, an air filter 40, an air pressure regulator 42, and a regulator supply line 44 feeding from the air pressure regulator and to a pressure gauge 46 and the control assembly 14. The air delivery assembly 12 is operable to receive pressurized air from the pressurized air source, as noted above. The pressurized air source can either be compressed air received from an air compressor (not shown) operable to provide approximately 45-120 psi of air pressure, or, alternatively, the pressurized air source can be the primary power system 38, such as the GraverMax or GraverMach primary power systems sold by Glendo Corporation and described in U.S. Pat. No. 7,413,027 ("the '027 patent"), entitled "Impact Power Tool with a Precision Controlled Drive System," the entirety of which is incorporated by reference herein. As known in the art, a motive fluid may also be used instead of the pressurized air source. Because the control system 10 of embodiments of the present invention is specially designed for use with the primary power system 38, operation of the control system 10 with the primary power system 38 will be described herein. However, it is to be understood that the control system 10 may be used with a direct pressurized air source, such as the air compressor.

The supply line 36 of the air delivery assembly 12 is in fluid communication with the primary power system 38 and thus, provides pressurized air to the control system 10, as illustrated in FIG. 1. As discussed in more detail in the '027 patent, the primary power system 38 is operable to receive pressurized air from the pressurized air source, such as the air compressor. When the control system 10 is used in conjunction with the primary power system 38, the pressurized air from the source is fed to the primary power system 38, where it is split into two lines—a first line (not shown) to power the primary power system 38, and a second line to the control system 10, namely the supply line 36. The supply line 36 is guided through the back panel 28 of the housing 20, as illustrated in FIG. 1, and to the air filter 40, as illustrated in FIG. 3. The supply line 36 and any other lines discussed herein are a plastic hose operable to withstand transmittal of pressurized air therethrough.

As illustrated in FIG. 3, the air filter 40 is disposed between adjacent first and second sections 36*a*,36*b* of the supply line 36 and before receipt of the pressurized air through the air pressure regulator 42. The air filter 40 is any air filter well known in the art and operable to filter air incoming from the supply line 36 and the primary power system 38. A suitable air filter is sold by Industrial Specialties Manufacturing under product code No. 57100.

Once air exits the air filter 40, the air is guided through the second section 36*b* of the supply line 36 and to the air pressure regulator 42, which regulates the air to a desired pressure. Any suitable air pressure regulator may be used, such as the regulator provided by SMC Corporation of America under product code IR1010-N01. As noted above, in embodiments of the present invention, the primary power system 38 and the control system 10 share a common supply of pressurized air. As described in the '027 patent, the primary power system 38 regulates the pressurized air used by the system 38. The control system 10 also includes its own, separate air pressure regulator 42 to regulate the pressurized air used by control system 10 to a narrow range of psi dependent on a user's desired pressure.

As described in the '027 patent, unregulated pressurized air is usually approximately 35-100 psi and must be scaled down to a smaller pressure for operation of the primary power system 38. The primary power system 38 typically regulates the pressure to a range of 8-25 psi. Similarly, the air pressure regulator 42 of the control system 10 adjusts to the desired operating pressure via an air regulator dial 48 mounted on the front panel 30 of the housing 20. Advantageously, the control system 10 allows the user to specify the desired pressure dependent on the user's preference, the type of material being worked on, and other operating parameters. This allows the user to fine tune even more the response of the control system 10 and allows the user to limit the maximum power or increase and/or decrease the response of the system 10. For example, if the user desires low pressure for very fine detail work, the user can regulate the pressure to the range of approximately 5-8 psi via the air regulator dial 48. However, if the user desires a higher pressure for more general work, such as when first beginning carving of an article, then the user may select a range of 8-15 psi via the regulator dial 48. Applicants have found that the optimal pressure range for use of the control system 10 of embodiments of the present invention is approximately 2-35 psi and more preferably approximately 5-20 psi and most preferably approximately 5-15 psi.

The control assembly 14 comprises an exhaust line 50 from the primary power system 38 and to the control assembly 14, a spool valve 52 in fluid communication with the regulator supply line 44 and the exhaust line 50, a control line 54, a switch valve 56, and first and second switch valve control lines 54*a*,54*b*. Air exiting the air pressure regulator 42 is moved through the regulator supply line 44 and to the control assembly 14, as illustrated in FIG. 3.

The spool valve 52 of embodiments of the present invention is advantageously designed to precisely control the air communicated to the handpiece 18 based upon user instructions, as discussed in more detail below. As illustrated in FIGS. 4-8, the spool valve 52 comprises a spool containment body 58 defining a hollow interior 60, a spool 62 housed within the interior 60 of the body 58, a control chamber 64, a load chamber 66, a reference chamber 68 in fluid communication with the atmosphere, a supply input port 70 in fluid communication with the control chamber 64, an output port 72 also in fluid communication with the control chamber 64, an exhaust input port 74 in fluid communication with the exhaust line 50 and the load chamber 66, a contoured metering slot 76 carved in the load chamber 66, a spring 78 housed within the reference chamber 68 of the body 58, and a spring preload adjustment screw 80 also housed within the reference chamber 68. The regulator supply line 44 is in fluid communication with the spool valve 52 via the supply input port 70.

The chambers 64-68 of the spool valve 52 are called out only for purposes of explanation of the spool valve 52, and it is not intended that the chambers 64-68 be understood as distinct structures. Instead, the chambers 64-68 are formed by the location of the spool 62 within the body 58, and therefore, the chambers 64-68 are not necessarily of equal size, including equal length and volume, and the size of the chambers 64-68 changes as the location of the spool 62 within the body 58 changes during operation. Thus, the chambers 64-68 are not formed by any internal wall.

The spool containment body 58 is formed of steel, aluminum, or other suitable material. The body 58 is generally rectangular in shape and includes left and right ends 82,84, front and back sides 86,88, and top and bottom sides 90,92. The left end 82 of the body 58 is secured to an inset 93 on an inside of the front panel 30 of the housing 20, such that the spool valve 52 is secured within the housing 20. The body 58 is approximately 8.8 cm in length, 1.8 cm in width, and 1.8 cm in height. The body 58 includes a cut-out 94 formed in a general middle third of the body, approximately 3.3 cm from the left end 82 and 4.2 cm from the right end 84, such that the cut-out 94 is approximately 1.3 cm in length and approximately 0.4 cm in width. The cut-out 94 is formed in the front side 86 of the body 58 along an entire height of the body 58. The metering slot 76 is formed in the cut-out 94, as further discussed below. It is to be understood that the measurements of the spool containment body 58 may be changed dependent on the size of the spool 62, metering slot 76, etc.

The supply input port 70 is formed in the left end 82 of the body 58, such that the input port 70 is in fluid communication with the control chamber 64, as noted above. The input port 70 is preferably configured to receive a threaded port fitting 96 that can be screwed into the left end 82 of the body 58 via mating threads on the fitting 96 and the body 58. The port fitting 96 also preferably includes a metering orifice 98 that is sized to control, and in preferred form restrict, the amount of air supplied to the control chamber 64.

The output port 72 is in fluid communication with the control line 54. The output port 72 is formed in the top side 90 of the body 58 and includes a hose connector 100. Although the hose connector 100 does not meter the pressurized air fed therethrough to the same extent as the metering orifice 98, the hose connector 100 does change the flow of the air therethrough. Alternatively, the hose connector 100 could be a metering orifice similar to the metering orifice 98 of the supply input port 70.

As noted above, the exhaust input port 74 is in fluid communication with the exhaust line 50 and the load chamber 66. The exhaust input port 74 is formed in the top side 90 of the body 58 and is configured to receive an elbow fitting 102. The elbow fitting 102 is then configured to receive the exhaust line 50. The exhaust line 50 is directly fluidly connected to the primary power system 38, and in preferable form, the exhaust line 50 is guided through the back panel 28 of the housing 20. Although discussed in more detail below, exhaust air from the primary power system 38 is fed through the exhaust line 50 and to the load chamber 66 of the spool valve 52. This exhaust air provides a load of pressurized air to the load chamber 66. As the air is exhausted from the load chamber 66 via the metering slot 76, this results in operation of the handpiece 18, as more fully explained below.

Figure 8:
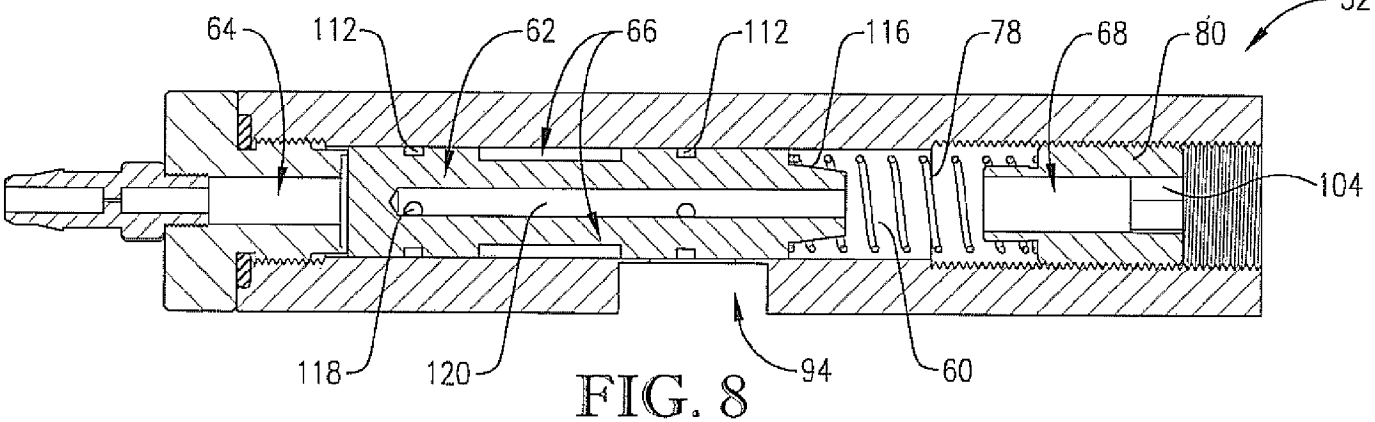
FIG. 8 is a vertical cross-sectional side view of the spool valve and illustrating the spool.

As illustrated in FIG. 8, the spring 78 and spring preload adjustment screw 80 are both housed within the reference chamber 68 of the body 58, at a general right end 84 of the body 58. The spring 78 is preferably any well-known compression spring sized to move freely within the body 58. The spring 78 is disposed between the spool 62 and the adjustment screw 80. The adjustment screw 80 preferably includes a vent 104 that allows air in the reference chamber 68 to vent to the atmosphere, the purpose of which is discussed in more detail below.

The location of the spring 74 within the body 58 can be changed via the adjustment screw 80, which can be moved further within the body 58 (i.e, towards the left end 82) depending on a preferred piston stroke of the handpiece 18. Because the size and relationship of the spool 62 to the body 58 is within fairly strict tolerances, it is necessary for the spring 78 to consistently fall within a range of compression lengths. However, the manufacturing tolerances for compression springs are not such that every spring will compress the same length upon application of the same amount of force. Moreover, material fatigue in the spring 78 will change over time, such that even if springs could be manufactured with consistent compression ratios, a particular spring's compression length will likely change overtime. Therefore, embodiments of the present invention provide the spring preload adjustment screw 80, which allows for variable adjustment of the spring 78. The spring 78 can be preloaded during manufacture, i.e., positioned within the body 58, to allow for precise calibration and consistency of multiple control systems 10. As can be appreciated, because the spring 78 is disposed between the spool 62 and the adjustment screw 80, positioning of the screw 80 within the body 58 will directly affect how much pressurized air must be fed to the control chamber 64 to force movement of the spool 62 towards the right end 84 of the body 58.

The spool 62 of the valve 52 is advantageously designed to variably restrict the flow of air through the spool containment body 58, based upon the user's desired handpiece 18 control and operation. The spool 62 is generally cylindrical in shape, as further described below, and is sized to fit snugly within the interior of the body 58, such that it can easily move longitudinally within the body 58 but that as little air as possible is allowed to flow through the body 58.

The spool 62 generally comprises left, middle, and right sections 106,108,110. The left section 106 is positioned proximate to the left end 82 of the valve body 58, and the right section 110 is positioned proximate to the right end 84 of the valve body 58. Along its length, the spool 62 includes three varying diameters, wherein a first diameter is the largest diameter, a second diameter is smaller than the first diameter, and a third diameter is smaller than the second diameter.

The left and right sections 106,110 of the spool 62 include grooves 112 formed therein, such that the left and right sections 106,110 are generally of the first diameter, but the grooves 112 formed therein are of the second diameter, as illustrated in FIG. 8. The left section includes a generally flat end 114, whereas the right section 110 includes an angled mating segment 116 configured to fit within and hold the spring 78 in position. The middle section 108 of the spool 62 is of the third diameter (i.e., the smallest diameter), such that the spool shape, along its length, is generally hourglass. The left section 106 of the spool 62 is approximately 1.1 cm in length, the middle section 108 is approximately 1.2 cm in length, and the right section 110 is approximately 1.5 cm in length, excluding the angled segment 116, and approximately 2 cm including the angled segment 116. Smaller and larger spools could be used depending on desired power and performance characteristics.

The grooves 112 of each of the left and right sections 106,110 include a vent 118 formed along a height of the spool 62. Additionally, the spool 62 includes a central vent 120 formed along a length of the spool 62. The purpose of the vents 118,120 is to allow for air leaked from the control and load chambers 64,66 to be vented to the reference chamber 68 and thus, to atmosphere. This isolates the pressure in the control and load chambers 64,66, which results in smoother movement of the spool 62 within the body 58 and, consequently, smoother operation of the handpiece 18. As can be appreciated, the manufacturing clearances necessary for positioning the spool 62 within the interior 60 of the valve body 58 allow for at least some air leakage from, for example, the control chamber 64. Thus, for example, without the vent 118 in the groove 112 of the left section 106, the air would then leak to the load chamber 66, which would change the pressure differential between the two chambers 64,66. Because the grooves 112 of the left and right sections 106,110 are of a smaller diameter than the sections themselves, air can become trapped in the grooves 112 and forced into the vents 118. The air is then transferred along the central vent 120 to the reference chamber 68. This maintains isolation of the chambers 64-68 and prevents undesired changes in pressure differential among the chambers 64-68.

As discussed above, where the spool 62 is positioned along the length of the valve body 58 defines where the chambers 64-68 are formed at any given instant. Thus, the control chamber 64 is formed on the left end 82 of the body 58 and by the valve body 58 and the left section 106 of the spool 62. Similarly, the reference chamber 68 is formed on the right end 84 of the body 58 and by the valve body 58 and the right section 110 of the spool 62. The load chamber 66 is formed by the valve body 58 and the middle section 108 of the spool 62 and, in particular, the third diameter (i.e., the smallest diameter). As described in more detail below, when the middle section 108 of the spool 62 is generally aligned with the exhaust input port 74, the middle section 108 forms the load chamber 66, such that air from the exhaust line 50 is held within the volume defined by the cut-out 94 of the valve body 58 and the inner diameter of the middle section 108 of the spool 62. The third diameter is therefore sized to allow the precise volume of desired air within the load chamber 66. As the spool 62 travels longitudinally within the valve body 58 and against the spring 78, the load chamber 66 moves into alignment with the contoured metering slot 76, exhausting the air to atmosphere at a rate based on the open area of the metering slot 76, as discussed in detail below. As the air is exhausted from the load chamber 66 via the metering slot 76, the piston of the handpiece 18 is actuated.

Figure 20:
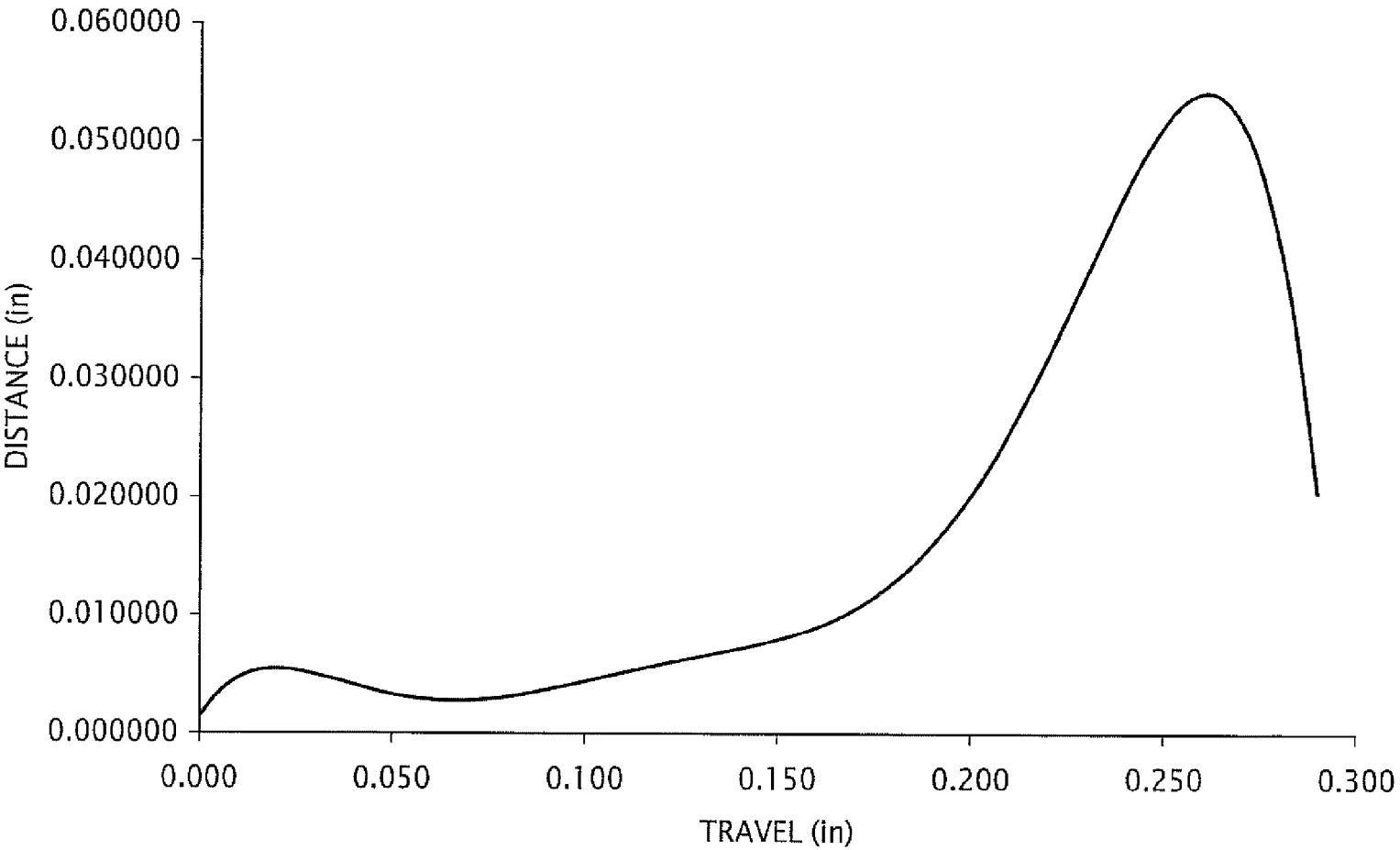
FIG. 20 is a graph illustrating a shape of a metering slot formed in the spool valve and a distance the spool travels in the spool valve with respect to alignment of the metering slot.

The contoured metering slot 76 of the spool valve 52 provides advantages over other metering slots in the art because its shape allows for precise control and application of the pressurized air. The metering slot 76 of embodiments of the present invention is in the general shape illustrated in FIG. 20. This graph illustrates a distance the spool 62 travels along the x-axis. An area under the curve up to any given point is proportional to the length of travel of the piston of the handpiece 18. As the spool 62 travels along the metering slot 76, and in particular, as the load chamber 66 becomes aligned with the metering slot 76, the piston correspondingly travels in the handpiece 18. As can be seen in the graph, the metering slot 76 starts out with a small area, such that the air exhausted out of the metering slot increases at a small rate up to approximately 0.02 in of travel of the spool, increases at a slightly lower rate between approximately 0.02 and 0.07 inches of travel of the spool, and then increases at a increasingly higher rate from approximately 0.07 inches of travel up to 0.26 inches of travel of the spool, i.e., when the load chamber 66 is past the metering slot 76. The initial slight increase and then immediate decrease of the rate of increase is so the user knows that the control system 10 is operating, and further, that the user can obtain a baseline for how much pressure must be applied to a control point. This is because the pressure used for the control system 10 is so small, and the system 10 is so quiet, that the user may not realize that the handpiece 18 is operating until the piston is traveling with a much greater stroke length, which may then be too late to precisely control the handpiece 18 and its hammer tool.

Figure 21:
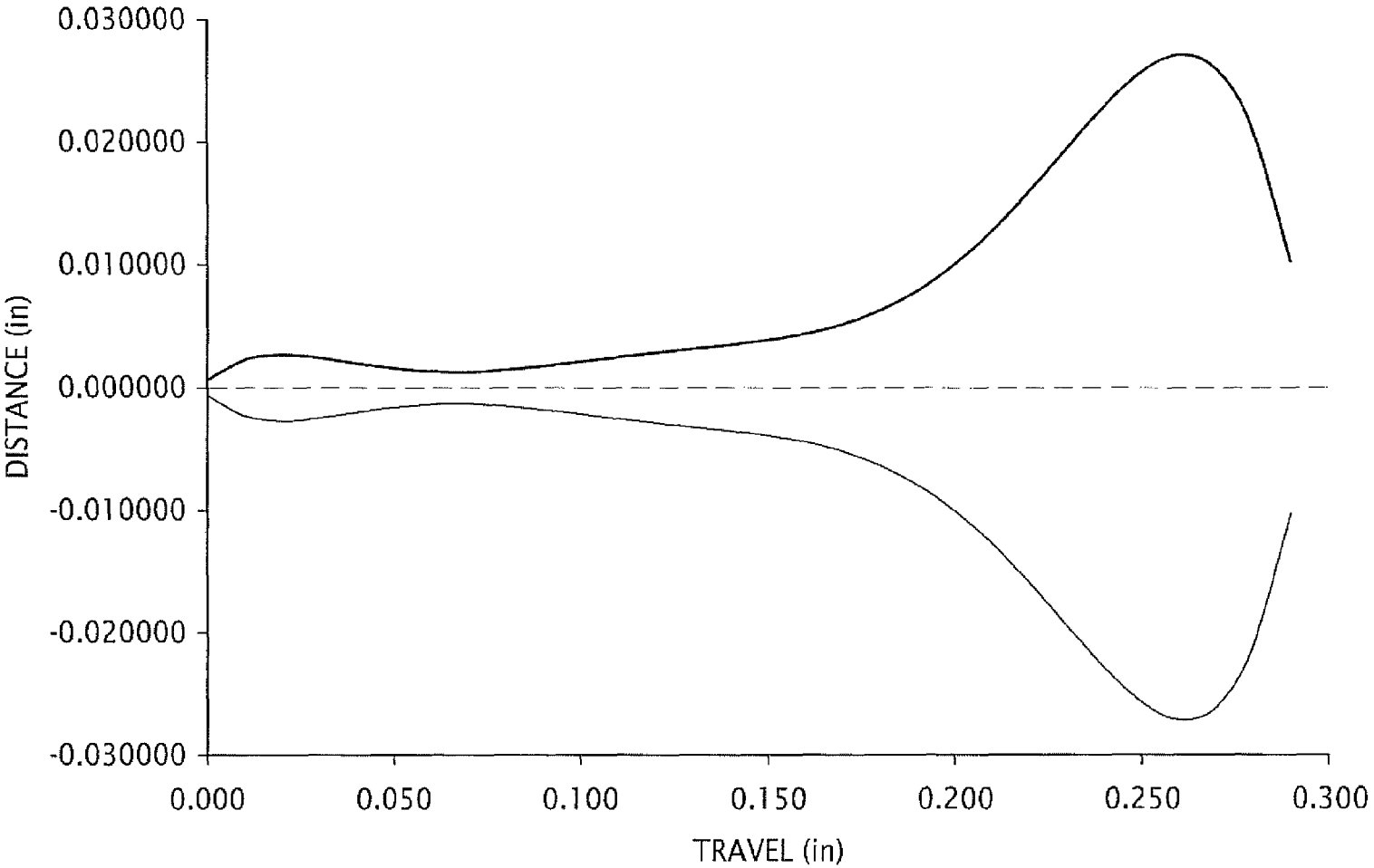
FIG. 21 is a graph illustrating an alternative shape of a metering slot formed in the spool valve and a distance the spool travels in the spool valve with respect to alignment of the metering slot.

A metering slot 76 having no more than one axis of symmetry provides the appropriate rate of increase and decrease of piston travel for the handpiece 18. Although the metering slot 76 illustrated in FIG. 20 does not have an axis of symmetry, the same distance of travel could be obtained via a metering slot having no more than one axis of symmetry, such as is illustrated in FIG. 21. Having two axes of symmetry does not provide the desired precision control, however, because the piston initially travels too much. For example, if the metering slot 76 was rectangular, the rate of change of travel of the piston at any instant would be the same regardless of how much pressurized area is held in the control chamber 64, thus not providing precision control or variability. Alternatively, if the metering slot 76 was circular or oval, the rate of change of travel of the piston would be desirably smaller at the beginning of travel because the load chamber would be in alignment with a first smaller area of the circle or oval metering slot, would increase as more air is exhausted out of the metering slot along a middle segment of the circle or oval, which has the largest area, but then would decrease again once the spool travels to a second smaller area of the circle or oval. This type of metering slot does not provide consistent or intuitive control.

An alternative way of describing the shape of the metering slot is with respect to the percentage of length of the metering slot 76 versus the distance of travel of the piston of the handpiece 18. As described in more detail below and in the '027 patent, a piston 122 drives a hammer tool 124, such as a chisel, of the handpiece 18. The length of travel of the piston 122 affects how much power the hammer tool 124 has upon impact. In preferable form, the length of travel of the piston 122 increases as more length of the metering slot 76 is exposed, i.e., more of the load chamber 66 is exposed to the metering slot 76, thus allowing more air to be exhausted. Note that this relationship is also directly associated with the open area of the metering slot 76. Therefore, within approximately 0%-20% of the length of the slot 76, the piston 122 of the handpiece 18 travels approximately 0%-5% of its entire length of travel; within approximately 20%-40% of the length of the slot 76, the piston 122 travels approximately 5%-15% of its entire length of travel; within approximately 40%-60% of the length of the slot 76, the piston 122 travels approximately 15%-30% of its entire length of travel; within approximately 60%-80% of the length of the slot 76, the piston 122 travels approximately 30%-50% of its entire length of travel; and within approximately 80%-100% of the length of the slot 76, the piston 122 travels approximately 50%-100% of its entire length of travel. Therefore, although approximate, the relationship of the distance of spool travel to the distance of piston travel is generally logarithmic or at least generally non-linear.

As noted above, the control line 54 extends from the output port 72 of the spool valve 52 and to the switch valve 56. As illustrated in FIG. 1, the first and second switch valve control lines 54*a*,54*b* extend from the switch valve 56, through the front panel 30 of the housing 20, and to the handpiece 18. Only one power tool can be operated by the control system 10 at a given time. However, the control system 10 is provided with two interfaces 126 to the control line 54 via the first and second switch valve control lines 54*a*,54*b*. The user can then connect two tools, such as the hand piece 18 and a foot-operated tool, to the control system 10 and actuate the switch valve 56 to control which tool is powered.

The tool assembly 16 comprises the handpiece 18, the first and second switch valve control lines 54*a*,54*b*, one of which is disposed between and in fluid communication with the switch valve 56 (and consequently, the spool valve 52) and the handpiece 18, and a pulsed air supply line 128 from the primary power system 38 and to the handpiece 18. Alternatively, the pulsed air supply line 128 could feed non-pulsed, pressurized air. Regardless of whether supplying pulsed or non-pulsed pressurized air, the supply line 128 provides pressurized air to the handpiece 18. The switch valve control lines 54*a*,54*b* are continuations of the control line 54 extending from the output port 72 of the spool valve 52, except that at the point of the switch valve 56, the control line 54 is split into two lines, i.e., the first and second switch valve control lines 54*a*,54*b*, for the selective control of two tools, as noted above.

The handpiece 18 of embodiments of the present invention is especially designed to operate with the control system 10 of embodiments of the invention and further, to provide a handpiece that allows for precision control of the hammer tool 124. The handpiece 18 comprises a body 130, a hollowed neck threadably connected with the body 130, the piston 122 primarily housed within the neck 132 and operable to move between the body 130 and the neck 132, and a spring 134 housed within the neck 132.

The body 130 of the handpiece 18 includes a generally circular, tapered first segment 136 having a first diameter, and a generally circular second segment 138 having a second diameter smaller than the first diameter and extending from the first segment 136. The first segment 136 is the primary segment held by the user during operation. The body 130 also presents a generally hollowed interior 140 divided into first and second chambers 142,144, wherein the first chamber 142 is operable to receive one of the switch valve control lines 54*a*,54*b*, and the second chamber 144 is operable to receive the pulsed air supply line 128 from the primary power system 38. In preferred form, the first and second chambers 142,144 of the body 130 are isolated, such that pressurized air pumped into the first chamber 142 does not flow to the second chamber 144 and vice-versa.

Threads 146 are preferably formed within the hollowed interior 140 of the second segment 138, and similarly, mating threads 148 are preferably formed on the neck 132, such that the neck 132 is operable to be secured to the body 130 via mating of the threads 146,148. Alternatively, the body 130 and neck 132 could be integrally formed or could be secured together via screws or other similar securement devices. The neck 132 is also operable to receive the hammer tool 124, such as the chisel, in any well-known manner. A threaded, cylindrical grip 150 is threaded over the neck 132 and acts as a continuation of the body 130 upon assembly of the handpiece 18. The grip 150 includes multiple indentations 152 to facilitate gripping of the handpiece 18 during use.

As noted above, the spring 134 and piston 122 are both housed within the neck 132. In more detail, the piston 122 is generally cylindrical and includes a cut-out 154 for partial receipt of the spring 134. The piston 122 is operable to move between the second chamber 144 of the body 130 and the hollowed neck 132 during operation, as described in more detail below. The piston 122 is thus spring-loaded and air actuated by pressurized air incoming from the pulsed air supply line 128 of the primary power system 38 and to the second chamber 144 of the body 130. The piston 122 is operable to move forward and backward along a stroke length upon injection of the pressurized air into the second chamber 144. This results in impact of the hammer tool 124, as discussed in more detail below.

Figures 10, 11, 12, 13:
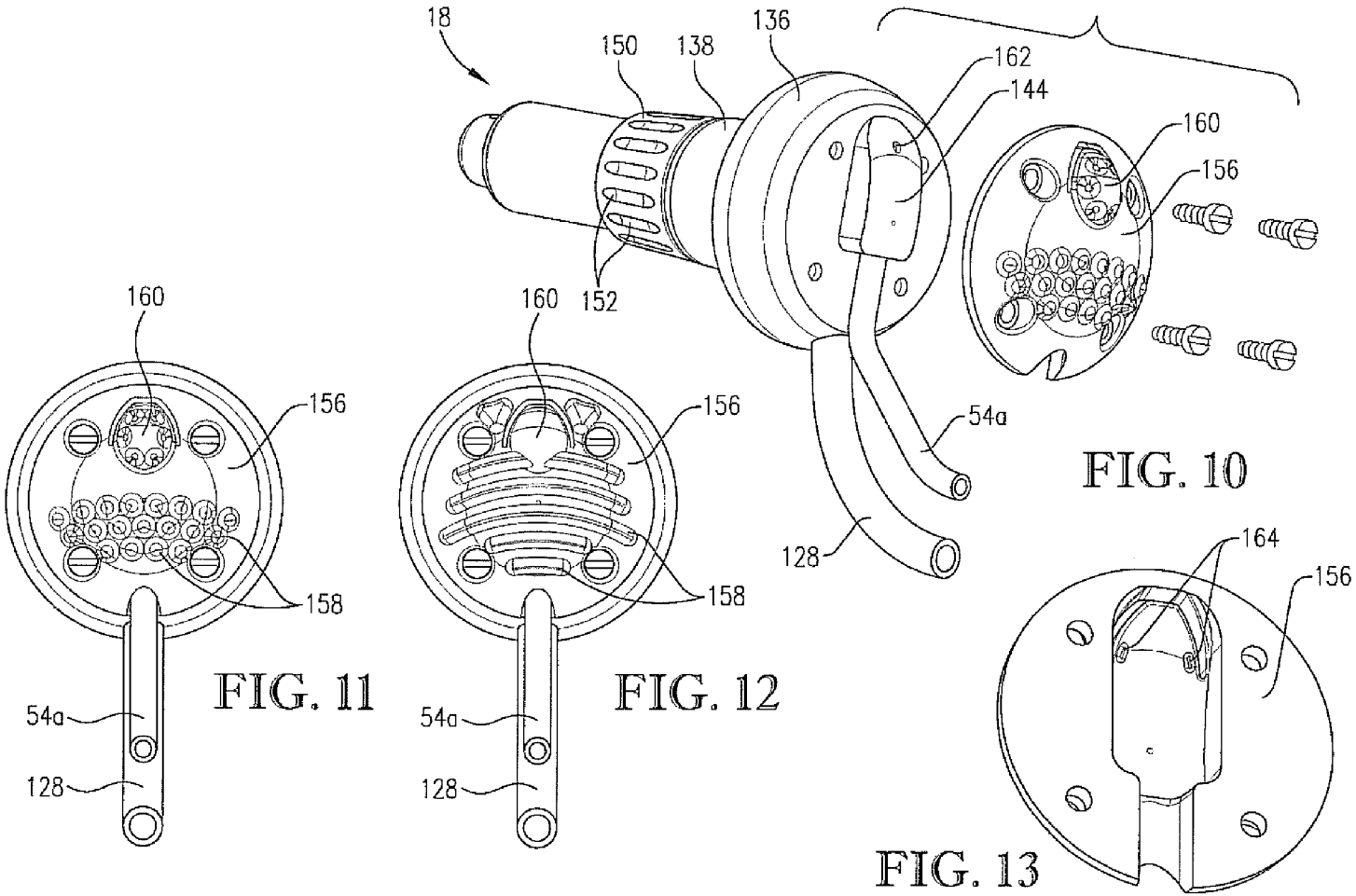
FIG. 10 is an exploded view of a handpiece of embodiments of the present invention.
FIG. 11 is an end view of the handpiece and illustrating a touch pad with a first array of gripping protrusions.
FIG. 12 is an end view of the handpiece and illustrating the touch pad with a second array of gripping protrusions.
FIG. 13 is a back face of the touch pad and illustrating a flapper of the touch pad and an array of lifting protrusions formed on the flapper.
Figure 14:
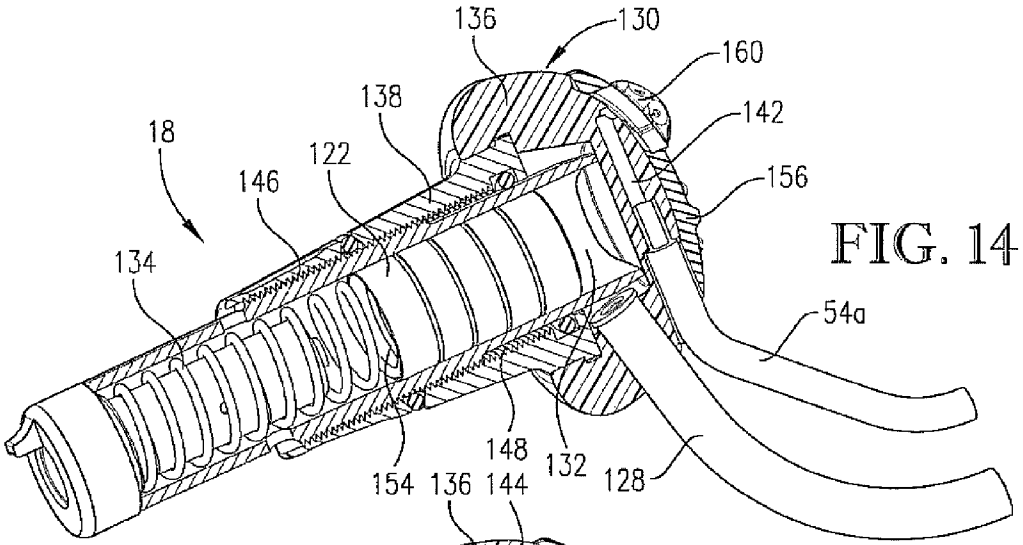
FIG. 14 is a perspective, vertical cross-sectional view of the handpiece of embodiments of the present invention and illustrating a spring and piston housed within the handpiece, wherein the spring is in a retracted rest state.
Figure 15:
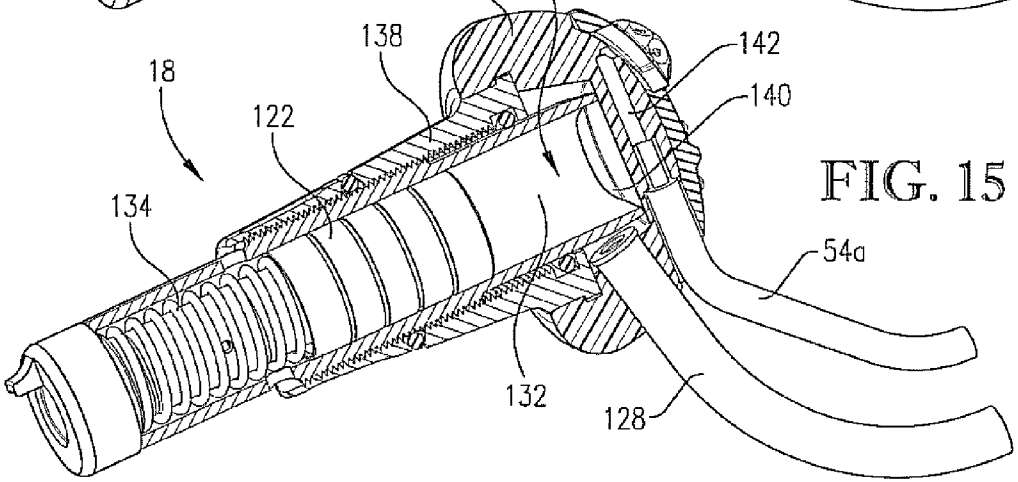
FIG. 15 is a perspective, vertical cross-sectional view of the handpiece of embodiments of the present invention and illustrating a spring and a piston housed within the handpiece, wherein the spring is in a compressed state.

Returning to the description of the body 130 of the handpiece 18, a touch pad 156 formed of rubber, neoprene, or other suitably resilient material is secured to an outer surface of the first segment 136 of the body 130, as illustrated in FIGS. 10-13. The touch pad 156 includes a pattern of gripping protrusions 158 and a resilient flapper 160. The gripping protrusions 158 provide a surface against which the user's fingers, palm of hand, or other gripping body member may contact for facilitating handling and control of the handpiece 18. As also illustrated in FIGS. 11-12, alternative touch pads 156 may be provided so that the user may select the type of touch pad 156 preferred for a particular use. For example, the touch pad 156 illustrated in FIG. 12 requires more force by the user to actuate the piston 122 than the touch pad 156 illustrated in FIG. 11.

The resilient flapper 160 is advantageously designed to provide precision control of the handpiece 18. In more detail, the flapper 160 covers a small orifice 162 formed in the first segment 136 of the body 130. The flapper 160 is formed from cutting the touch pad 156 at the desired location of the orifice 162.

The flapper 160 is also raised from the touch pad 156 so that the user can better actuate the touch pad 156 to obtain the precision control. Because, the touch pad 156 is formed of a resilient material, and further because the flapper 160 is cut from the touch pad 156, the flapper 160 is formed of the same resilient material. Alternatively, the flapper 160 could be a separate item that is secured to the touch pad 156 or to the body 130 of the handpiece 18. Regardless, the flapper 160 is preferably resilient such that upon release of pressure by the user against the flapper 160, the flapper 160 returns to a rest state.

The orifice 162 is in direct fluid communication with the first chamber 142, which is in fluid communication with one of the switch valve control lines 54*a*,54*b*. Therefore, selective covering or opening of the orifice 162 directly affects how much pressurized air is allowed to bleed out of the control line 54, and consequently, out of the control chamber 64 of the spool valve 52. Thus, the orifice 162, which will hereinafter also be referred to as the control point for the user, is the primary mechanism of user control of the handpiece 18.

An underside of the resilient flapper 160 also includes a plurality of extremely small lifting protrusions 164. Although small, the lifting protrusions 164 advantageously prevent complete closing off of the orifice 162, unless the user provides a significant amount of pressure on the flapper 160. The protrusions 164 thus, to a very small degree, lift the flapper 160 from the orifice 162. Also, as noted above, the flapper 160 covering the orifice 162 is resilient, such that when no pressure is applied by the user to the flapper 160, it returns to a rest state. In the rest state, the flapper 160 is still covering the orifice 162, although pressurized air is still allowed to bleed out. Thus, the protrusions 164 in conjunction with the resilient flapper 160 assist in preventing the flapper 160 from completely closing off the orifice 162, unless significant pressure is applied to the flapper 160. Applicants have found that the protrusions 164 on the underside of the flapper 160 facilitate the fine, precision control of the hand piece 18 and control system 10 and allow for subtle control not obtained with prior art handpieces.

The handpiece 18 described above, including the shape of the body 130 of the handpiece 18 and the location of the control point, is designed so that the handpiece 18 can be held in a variety of manners, depending on the preferred technique of the user. For example, the handpiece 18 could be gripped by the user like a pencil, such that the user's pointer finger rests on the flapper 160. Alternatively, the body 130 of the handpiece 18 could be held in the user's palm, such that a top of the palm of the hand covers the flapper 160. If the user prefers to actuate the flapper 160 with the user's thumb, the handpiece 18 could be held such that the user's pointer and middle fingers wrap around the first segment 136 of the body 130 and the user's thumb rests on the flapper 160. Thus, the handpiece design of the present invention allows multiple hand positions by the user.

Figure 16:
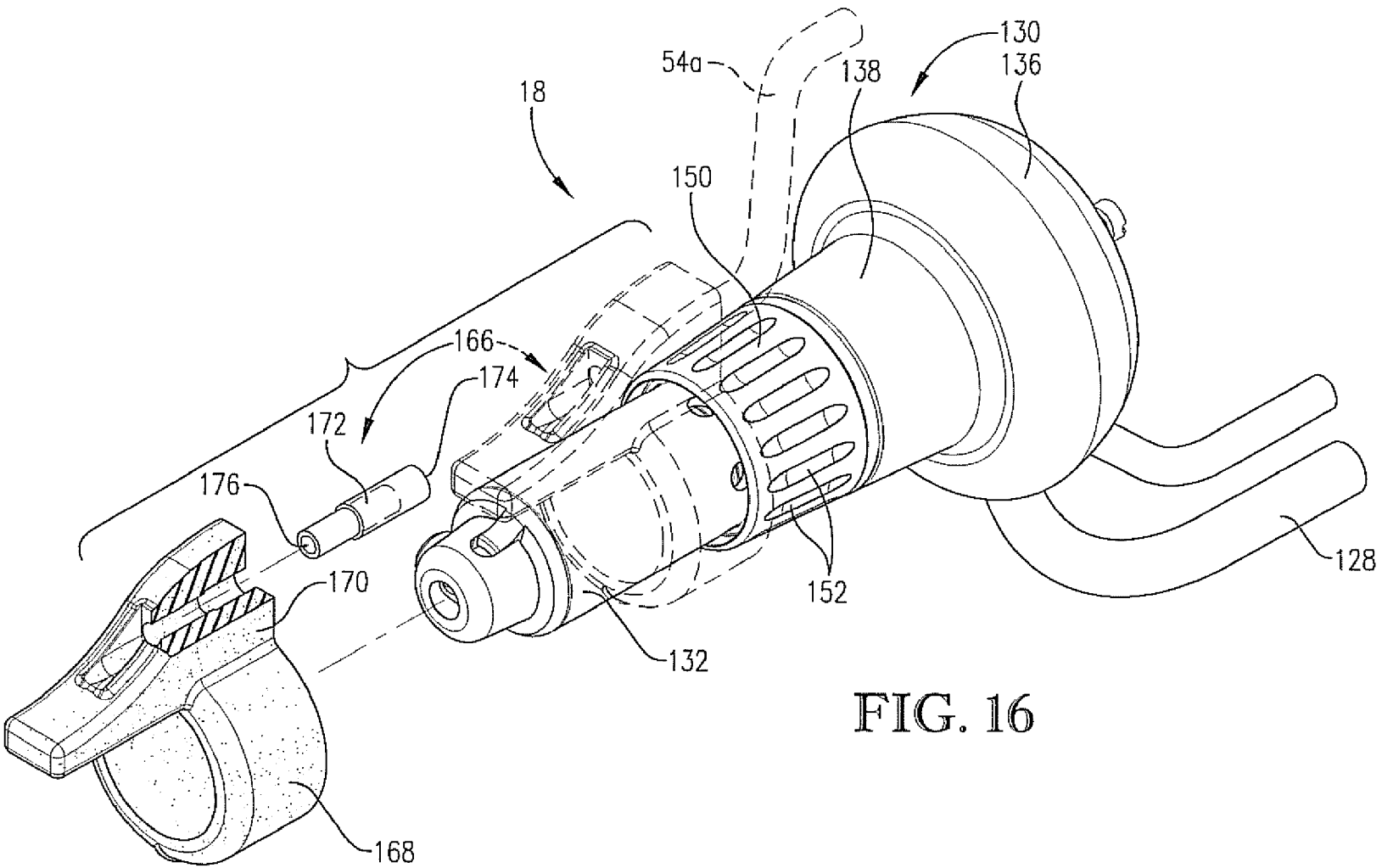
FIG. 16 is an exploded view of the handpiece of embodiments of the present invention and further illustrating a fingerpiece (both in solid line and in phantom) of embodiments of the present invention configured to be removably secured to the handpiece.

Embodiments of the present invention also provide a fingerpiece 166 that can be used with the handpiece 18 as the control point. As illustrated in FIG. 16, the fingerpiece 166 comprises a generally cylindrical, hollowed body 168 and a generally triangularly shaped member 170 extending from the body 168. The body 168 and member 170 are preferably integrally formed of rubber or neoprene. The body 168 is shaped to snugly fit over the neck 132 of the handpiece 18. The member 170 includes a hollowed opening 172 extending through the member 170, such that at a first end 174 of the opening 172, one of the two switch valve control lines 54*a*, 54*b* an be connected to the fingerpiece 166, and at a second end 176 of the opening 172, the user may position their thumb or other digit over the opening 172 so as to control the flow of pressurized air from the control chamber 64. For example, the user could wrap their hand around the neck 132 and body 130 of the handpiece 18 and position their thumb against the second end 176 of the opening 172. Alternatively, the user could position the body 130 of the handpiece 18 against the user's palm, and position the user's pointer finger on the second end 176 of the opening 172 of the fingerpiece 166. Thus, when the fingerpiece 166 is used in conjunction with the handpiece 18, the switch valve control line 54*a*,54*b* will be connected to the fingerpiece 166 and not through the second chamber 144 of the body 130 of the handpiece 18. Moreover, the second end 176 of the opening 172 becomes the control point for the pressurized air.

Embodiments of the present invention also provide a footpiece 178 that can be used with the handpiece 18 as the control point. As illustrated in FIGS. 17-19, the footpiece 178 comprises first and second plates 180,182 formed of steel, aluminum, or other suitable material and having first and second ends 184,186. The plates 180,182 are coupled together at their first ends 184. The second plate 182 is intended to be placed on the floor and includes rubber or neoprene pads (not shown) located on an underside of the plate 182. The first plate 180 is intended to support the user's foot, and it also includes rubber or neoprene pads 188 positioned to facilitate holding of the foot in place. The second plate 182 includes a T-shaped extension 190 extending from the second end 186. The extension 190 is configured to hold a rubber or neoprene ring 192. The ring 192 is configured to receive a rubber or neoprene wedge 194 that is configured to be positioned between the plates 180,182 at their second ends 186. The wedge 194 is fitted through the ring 192 and rests both on the T-shaped extension 190 and on the second end 186 of the plate 182. Because the first and second plates 180,182 are not secured to each other at their second ends 186, the wedge can fit snugly between the plates 180,182.

The wedge 194 includes first and second openings 196,198 connected by a channel (not shown) formed in the wedge 194. The first opening 196 is configured to receive one of the two switch valve control lines 54*a*,54*b*, and the second opening 198 is configured to rest under the second plate 182. Similar to the handpiece 18 and the footpiece 178, pressurized air enters the channel at the first opening 196, and the bleed out of the air is controlled by the user pressing on the first plate 182, which consequently covers to varying degrees the second opening 198. Thus, the second opening 198 is the control point for the pressurized air.

Operation of the control system 10 in conjunction with the primary power system 38 will now be described. As disclosed in the '027 patent, the primary power system 38 drives the piston 122 of the handpiece 18. Thus, operation of the piston 122 of the disclosed handpiece 18 herein is substantially the same as disclosed in the '027 patent and will only be described herein for explanation of the control system 10 of the present invention. In particular, the primary power system 38 pulses air to the second chamber 144 of the body 130 of the handpiece 18 via the pulsed air supply line 128 to drive the piston 122. As noted above, the primary power system 38 could alternatively supply non-pulsed, pressurized air via the supply line 128 to drive the piston 122. The pressurized air supplied to the piston 122 by the primary power system 38, however, is dependent on how much air is exhausted from the primary power system 38, as disclosed in the '027 patent. Because the control system 10 of the present invention is designed to work with the primary power system 38, the exhaust line 50 from the primary power system 38 is in direct fluid communication with the spool valve 52 of the control system 10. Thus, instead of the exhaust air from the primary power system 38 exhausting into atmosphere, as is done without use of the control system 10, the exhaust air exhausts to the spool valve 52 of the control system 10. Because the exhaust air through the spool valve 52 is metered, based on the shape of the metering slot 76, the rate at which the exhaust air is actually exhausted out of the control system 10 directly affects how the primary power system 38 drives the piston 122.

As disclosed in the '027 patent, pressurized air is supplied to the second chamber 144 of the body 130 of the handpiece 18. As more air is supplied to the chamber 144, the piston 122 is pushed forward against the spring 134. As the user exhausts the air out via a throttle (not shown), as disclosed in the '027 patent, the piston 122 is allowed to retract back. As the cycle continues and pressurized air is then supplied to the chamber again 144, the piston 122 again pushes forward against the spring 134. Because the piston 122 directly drives the hammer tool 124, the cycle of supplying pressurized air to the chamber 144 and exhausting the air out via the throttle actuates the piston 122 and drives the hammer tool 124. The amount of pressurized air exhausted from the chamber 144 directly affects how far back the piston 122 is positioned in the chamber 144, and thus, how long of a stroke length is made with the hammer tool 124. The more air exhausted from the chamber 144, the farther back the piston 122 moves within the chamber 144 (and away from the hammer tool 124), and the longer the stroke length of the piston 122. Often, the user does not desire to use the full stroke length of the hammer tool 124, and therefore, does not wish to exhaust as much pressurized air from the chamber 144. The control system 10 of embodiments of the present invention allows the user to finely and precisely control how much air is exhausted. This is, as noted above, because the exhaust line 50 from the primary power system 38 is fed through the control system 10 and, in particular, the spool valve 52.

As discussed above, two lines of pressurized air are fed to the spool valve 52 of the control system 10: the control line 54 and the exhaust line 50. The control line 54 is fed to the control chamber 64 of the spool valve 52, and the exhaust line 50 is fed to the load chamber 66 of the spool valve 52. Additionally, the control line 54 is in direct fluid communication with the control point of the handpiece 18, fingerpiece 166, or footpiece 178, as also described above. Thus, as the user varies the amount of pressurized air escaping from the control point, the amount of pressurized air held within the control chamber 64 changes. If, for example, the user does not allow air to escape from the control point, then pressurized air builds in the control chamber 64. As the volume of air within the control chamber 64 increases, the spool 62 of the spool valve 52 is correspondingly moved towards the right end 84 of the valve body 58, and the spring 78 in the reference chamber 68 is compressed by the spool 62. Because the reference chamber 68 is vented to atmosphere, there is a pressure differential existing between the control chamber 64 and the reference chamber 68. As the control chamber 64 expands and the spool 62 is moved towards the right end 84 of the valve body 58, the load chamber 66 becomes aligned with the metering slot 76. Just prior to alignment of the load chamber 66 with the metering slot 76, pressurized air from the exhaust line 50 is fed to the load chamber 66. Thus, as the load chamber 66 aligns with the metering slot 76, the pressurized air from the exhaust line 50 is vented to atmosphere at a rate dependent on the shape (and, consequently, exposed area) of the metering slot 76. If the user then allows the control point to stay open, the pressurized air from the control chamber 64 bleeds out at the control point. The compressed force of the spring 78 housed within the reference chamber 68 is then released, and the spring 78 retracts, which then pushes the spool 62 to the left end of the valve body 58, decreases the size of the control chamber 64, and moves the control chamber 64 out of alignment with the metering slot 76. If the user continues to allow the pressurized air to bleed out at the control point, the spool 62 does not move, or does not move to any significant amount, the exhaust air from the exhaust line 50 is not allowed to vent to atmosphere, the piston 122 stays at rest, and the hammer tool 124, consequently, does not move. Alternatively, if the user prevents, or mostly prevents, the pressurized air from bleeding out of the control point, the volume of pressurized air in the control chamber increases 64, which consequently forces the spool 62 to the right end 84 of the valve body 58, compresses the spring 78, aligns the load chamber 66 with the metering slot 76, and allows exhaust air to vent through the metering slot 76 to atmosphere. If the user maintains the same amount of restricted air flow out of the control point, the load chamber 66 will continue to be aligned with the metering slot 76 so that air is exhausted out of the metering slot 76 almost as quickly as it is supplied to the load chamber 66, resulting in continued pistoning of the piston 122, i.e., full throttle.

The user will most often operate the handpiece 18 between the above described extremes of the piston 122 being at rest and the piston 122 being at full throttle. In fact, users often prefer the hammer tool 124 operate at many levels and on a fluid continuum within the two extremes discussed. The handpiece 18 of embodiments of the present invention, and when used, the fingerpiece 166 and footpiece 178, provide a mechanism for precisely varying the operation of the hammer tool 124 along a continuum of levels and not at only selected levels, as does prior art devices.

Moreover, the control system 10 of the present invention, and in particular, the metering slot 76 of the spool valve 52 of the control system 10, provides for a more intuitive control of the handpiece 18. Even within a certain range of travel of the piston, the user can finely increment the piston travel with the assistance of the contoured metering slot 76. If a metering slot was used that was simply rectangular, circular, or elliptical, as are prior art slots, the user would not be able to finely increment the preferred piston travel within a certain range, as the air exhausted out of the prior art metering slot would not vary at the same rate as the metering slot of the present invention.

Although the invention has been described with reference to the preferred embodiment illustrated in the attached drawing figures, it is noted that equivalents may be employed and substitutions made herein without departing from the scope of the invention as recited in the claims. For example, in the above-discussed design, the air in the reference chamber 68 is vented to atmosphere, and therefore, the pressure of the reference air is the same as the atmospheric pressure. A design that uses a different reference pressure, such as a supply of pressurized fluid or gas, could alternatively be used.

Another alternative is that the instead of the control system 10 and primary power system 38 being housed in different units, as illustrated in FIG. 1, the two systems 10,38 could be housed in the same unit. In this embodiment, the systems 10,38 would still operate in conjunction with each other, with the only primary difference being that they are housed in the same unit. Therefore, it is to be understood that reference to the systems 10,38 herein is to comprise the systems 10,38 being housed independently or in the same unit, unless expressly noted otherwise.

Figure 4:
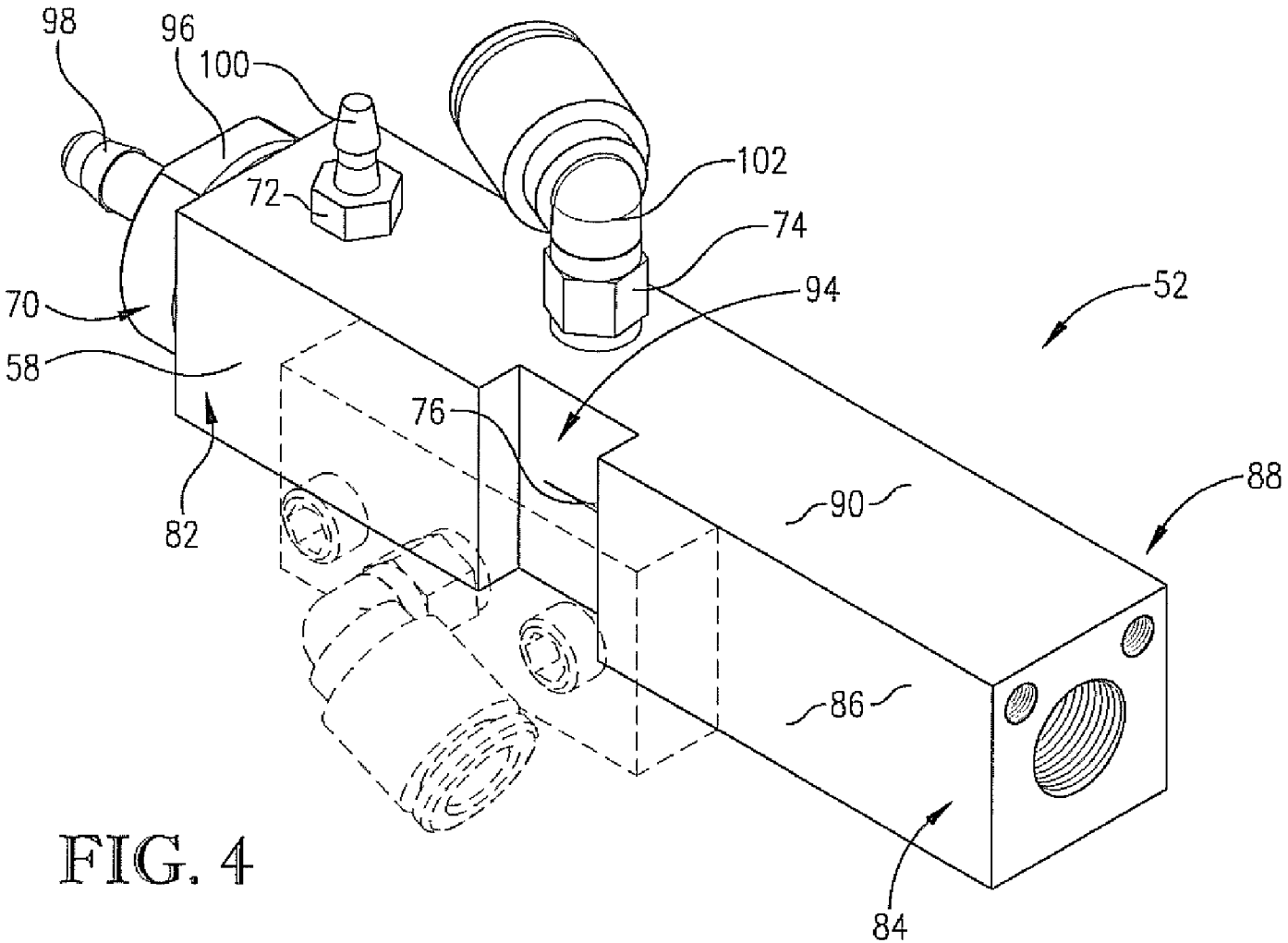
FIG. 4 is a perspective view of a spool valve of the control system.
Figure 5:
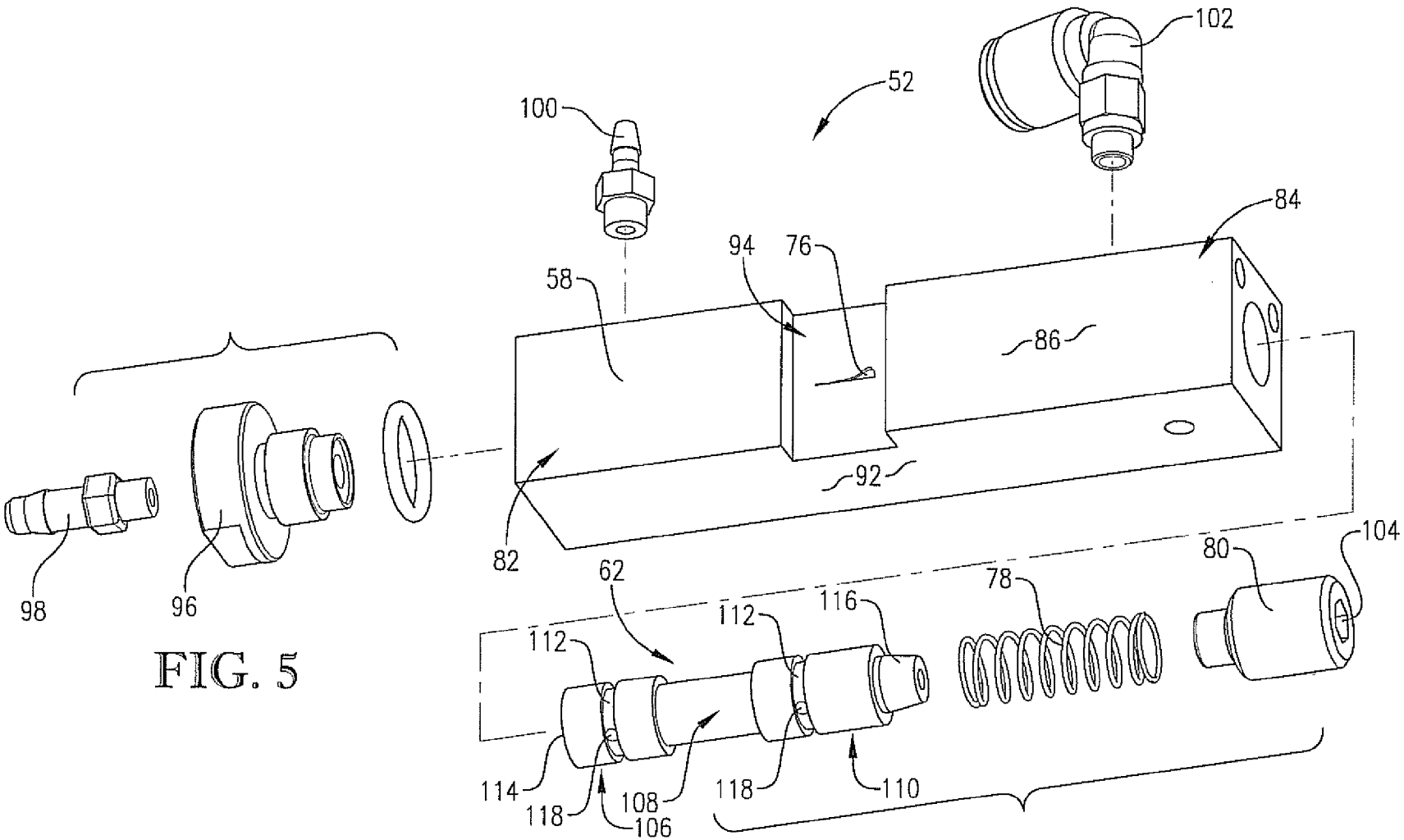
FIG. 5 is an exploded view of the spool valve and its internal components.
Figures 6, 9:
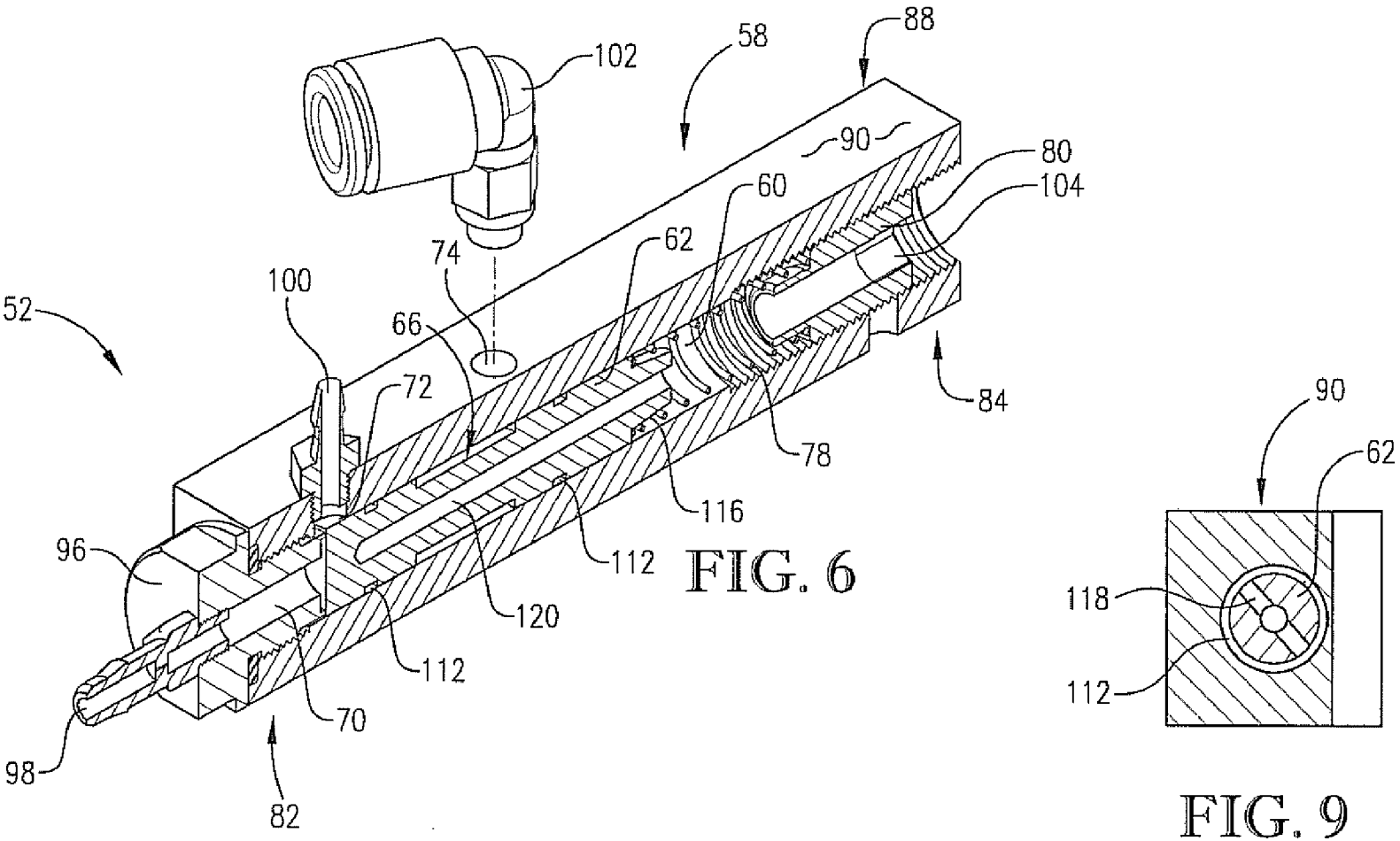
FIG. 6 is a perspective, vertical cross-sectional view of the spool valve and specifically illustrating a spool housed within the spool valve.
FIG. 9 is a cross-sectional view of the spool valve taken though line 9-9 of FIG. 7 and illustrating a vent on the right end of the spool valve.
Figure 7:
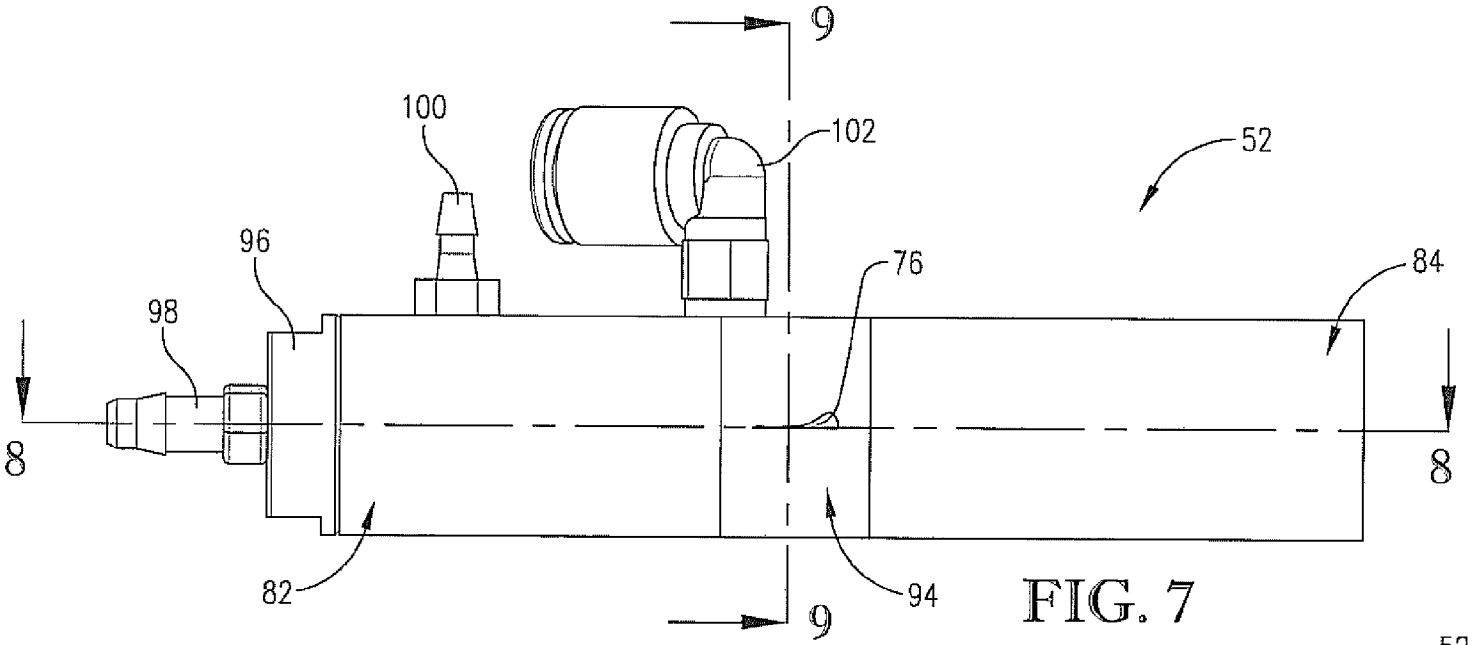
FIG. 7 is a front side view of the spool valve.

Another alternative is that instead of venting the air passing through the metering slot 76 of the load chamber 66 to atmosphere, a hose could be connected to the metering slot 76 to power an air tool, such that air vented from the metering slot 76 could be used to supply pressurized air to the air tool. FIG. 4 illustrates such a hose in phantom.

An even further alternative is that the three chambers 64-68 described above could be constructed using three separate components. For example, the control chamber 64 could be a discreet device, such as a small bellows or diaphragm assembly. The load chamber 66 could also be a discreet device, such as a pneumatic plunger valve connected to the control diaphragm by a mechanical connection. In this manner, the variation of pressurized air to the control chamber 64 would cause the control diaphragm to move, which in turn would control the pneumatic flow of air to the handpiece by the mechanically connected, but separate, plunger valve.

It is further noted that although the control system 10 of the present invention has been discussed with respect to operation with the primary power system 38, the control system 10 is also operable to, when used alone, control air pressure to a pneumatic device by using the spool valve 52 of the control system 10 to vary the pressurized air to the device.

Having thus described the preferred embodiment of the invention, what is claimed as new and desired to be protected by Letters Patent includes the following:

1. A control system for use in conjunction with a primary power system, the primary power system operable to power a hand-held tool, and the control system operable to control the amount of power to the tool, the control system comprising:

an air delivery assembly including a first supply line of pressurized air in fluid communication with the primary power system;

a control assembly including— an exhaust line from the primary power system and to the control assembly, a spool valve having a spool containment body, a spool housed within the body and operable to move freely along at least a portion of a length of the body, and a compression spring housed within the body, wherein a location of the spool within the body determines formation of a control chamber, a load chamber, and a reference chamber within the body, said spool valve being in fluid communication with the first supply line and the exhaust line, and a control line in fluid communication with the spool valve and the hand-held tool, wherein the first supply line is fed to the control chamber of the spool valve, and the exhaust line is fed to the load chamber of the spool valve; and a second supply line of pressurized air in fluid communication with the primary power system and the hand-held tool.

2. The control system of claim 1, wherein pressurized air is fed through the second supply line and operates to power the hand-held tool, and pressurized air is fed through the control line and operates to control the hand-held tool.

3. The control system of claim 2, wherein the primary power system operates to exhaust pressurized air so as to power the hand-held tool, and further wherein the exhausted air is fed through the exhaust line and to the spool valve of the control system so as to assist in control of the hand-held tool.

4. The control system of claim 1, wherein pressurized air is fed through the first supply line and to the control chamber of the spool valve, and pressurized air is fed through the exhaust line and to the load chamber of the spool valve.

5. The control system of claim 4, wherein the spring of the spool valve is housed within the reference chamber, and further wherein any air fed to the reference chamber is vented to atmosphere.

6. The control system of claim 5, wherein the body further includes a metering slot in a general location of the load chamber, such that air input into the load chamber can be exhausted out of the body upon alignment of the load chamber with the metering slot.

7. The control system of claim 6, wherein the pressurized air fed to the control chamber operates to expand the volume of the control chamber, which consequently forces the spool against the spring and allows the load chamber to align with the metering slot.

8. The control system of claim 4, wherein the pressurized air in the control chamber is operable to be exhausted out of the control chamber via the control line.

9. The control system of claim 8, wherein the hand-held tool is operable to be controlled by a user by selectively expelling the pressurized air in the control chamber via a control point on the hand-held tool that is in fluid communication with the control line.

10. A system for powering and controlling a piston-actuated power tool having a piston, the system comprising:

a primary power system including a first supply line in fluid communication with the tool, the primary power system operable to provide pressurized air to the tool so as to actuate the piston based upon a rate of exhausted pressurized air from the primary power system; and a control system for providing pressurized air to the tool so as to control the tool, the control system including— an exhaust line in fluid communication with the primary power system and the control system so as to supply the exhausted pressurized air from the primary power system and to the control system, a second supply line in fluid communication with a pressurized air source and the control system for supplying pressurized air to the control system, a spool valve in fluid communication with the exhaust line and the second supply line and including a metering slot, wherein the pressurized air from the pressurized air source is supplied to the spool valve via the second supply line, and wherein exhausted pressurized air from the primary power system is supplied to the spool valve via the exhaust line and exhausted out of the metering slot, and a control line in fluid communication with the second supply line and the power tool, wherein pressurized air supplied by the second supply line and to the spool valve is expelled from the spool valve via the control line by a user selectively expelling the pressurized air from the power tool, and wherein the selective expulsion of the pressurized air from the spool valve directly affects the amount of exhausted pressurized air exhausted from the metering slot of the spool valve.

11. The system of claim 10, wherein the spool valve includes a spool containment body, a spool housed within the body and operable to move freely along at least a portion of a length of the body, and a compression spring housed within the body.

12. The system of claim 11, wherein a location of the spool within the body determines formation of a control chamber, a load chamber, and a reference chamber within the body.

13. The system of claim 12, wherein the second supply line is fed to the control chamber of the spool valve, the control line is fed from the control chamber and to the tool, and the exhaust line is fed to the load chamber of the spool valve.

* * * * *